US010161619B2

(12) United States Patent
Casper et al.

(10) Patent No.: US 10,161,619 B2
(45) Date of Patent: Dec. 25, 2018

(54) LED ILLUMINATION DEVICE WITH VENT TO HEAT SINK

(71) Applicant: Eaton Intelligent Power Limited, Dublin 4 (IE)

(72) Inventors: Joseph R. Casper, Syracuse, NY (US); Christopher D. Nolan, Syracuse, NY (US); Walten Peter Owens, Syracuse, NY (US)

(73) Assignee: Eaton Intelligent Power Limited, Dublin 4 (IE)

( * ) Notice: Subject to any disclaimer, the term of this patent is extended or adjusted under 35 U.S.C. 154(b) by 0 days.

(21) Appl. No.: 15/388,825

(22) Filed: Dec. 22, 2016

(65) Prior Publication Data

US 2017/0184298 A1 Jun. 29, 2017

Related U.S. Application Data

(60) Provisional application No. 62/271,471, filed on Dec. 28, 2015.

(51) Int. Cl.
*F21S 2/00* (2016.01)
*F21V 15/01* (2006.01)
(Continued)

(52) U.S. Cl.
CPC ..... *F21V 29/74* (2015.01); *F21V 5/007* (2013.01); *F21V 15/01* (2013.01); *F21V 21/30* (2013.01);
(Continued)

(58) Field of Classification Search
CPC ..... F21V 29/74; F21V 29/75; F21V 29/76; F21V 29/77; F21V 29/78; F21V 29/83
See application file for complete search history.

(56) References Cited

U.S. PATENT DOCUMENTS 6,153,985 A 11/2000 Grossman
6,435,691 B1 8/2002 Macey et al.
(Continued)

FOREIGN PATENT DOCUMENTS

KR 20030031339 A 4/2003
WO WO-2013090536 A1 6/2013

OTHER PUBLICATIONS

"A Remaining Useful Life Prediction Method Based on Condition Monitoring for LED Driver", Proceedings of the IEEE 2012 Prognostics and System Health Management Conference (PHM-2012 Beijing) (2012): 1-5. Web.
(Continued)

*Primary Examiner* — Alexander K Garlen
(74) *Attorney, Agent, or Firm* — Fox Rothschild LLP

(57) ABSTRACT

A light fixture includes a housing comprising a body portion with an opening at a first end, a power supply at an opposing second end, and a heat sink comprising a plurality of fins between the opening and the power supply. A mating surface is positioned proximate to the opening. The mating surface includes a set of landing pad areas and a set of open areas. The fixture also includes a set of light emitting diode (LED) modules, each of which is positioned in the opening and secured to a landing pad area of the mating surface. The LED modules are arranged so that the plurality of open areas remain open to the atmosphere and provide an air path to and from the heat sink.

20 Claims, 8 Drawing Sheets

(51) Int. Cl.

| | |
|---|---|
| ***F21V 21/30*** | (2006.01) |
| ***F21V 23/00*** | (2015.01) |
| ***F21V 29/74*** | (2015.01) |
| ***F21V 29/83*** | (2015.01) |
| ***F21V 5/00*** | (2018.01) |
| *F21Y 115/10* | (2016.01) |
| *F21W 131/105* | (2006.01) |

(52) U.S. Cl.
CPC ..... *F21V 29/83* (2015.01); *F21W 2131/105* (2013.01); *F21Y 2115/10* (2016.08)

(56) References Cited

U.S. PATENT DOCUMENTS 6,962,423 B2 11/2005 Hamilton et al.
7,810,951 B1 * 10/2010 Lee ..... F21V 21/30 362/218
8,227,960 B2 7/2012 Huang
8,371,717 B2 2/2013 Lai
8,573,801 B2 11/2013 Artsyukhovich et al.
8,760,058 B2 6/2014 Song et al.
8,841,859 B2 9/2014 Chemel et al.
2005/0263777 A1 12/2005 Yano et al.
2005/0265019 A1 12/2005 Sommers et al.
2007/0262724 A1 11/2007 Mednik et al.
2008/0025028 A1 1/2008 Gloisten et al.
2008/0285271 A1 * 11/2008 Roberge ..... F21S 8/033 362/235
2009/0040470 A1 2/2009 Fukui et al.
2009/0067172 A1 3/2009 Inoue et al.
2010/0117553 A1 5/2010 Lee
2010/0171145 A1 7/2010 Morgan et al.
2010/0176706 A1 * 7/2010 Fu ..... F21V 29/004 313/46
2010/0225241 A1 9/2010 Maehara et al.
2010/0277076 A1 11/2010 Tracy et al.
2011/0050124 A1 3/2011 Bailey et al.
2011/0062872 A1 3/2011 Jin et al.
2011/0075433 A1 3/2011 Mart et al.
2011/0089865 A1 4/2011 Wang et al.
2011/0095690 A1 4/2011 Sagal
2011/0228529 A1 9/2011 Patel et al.
2011/0266972 A1 11/2011 Ling
2012/0033419 A1 2/2012 Kim et al.
2012/0153837 A1 6/2012 Park et al.
2012/0235579 A1 9/2012 Chemel et al.
2012/0250321 A1 * 10/2012 Blincoe ..... F21V 7/00 362/247
2012/0261105 A1 10/2012 Lin et al.
2012/0287613 A1 * 11/2012 Hamel ..... F21V 29/004 362/184
2013/0033881 A1 2/2013 Terazawa et al.
2013/0077307 A1 3/2013 Yamamoto
2013/0249375 A1 9/2013 Panagotacos et al.
2014/0159583 A1 6/2014 Bollmann
2014/0204584 A1 7/2014 Wu
2014/0334149 A1 * 11/2014 Nolan ..... F21V 5/007 362/235
2015/0054410 A1 2/2015 Sanders et al.
2015/0138770 A1 * 5/2015 Kwak ..... F21V 29/20 362/244
2015/0316249 A1 * 11/2015 Kinnune ..... F21K 9/60 362/235

OTHER PUBLICATIONS

International Search Report dated Apr. 29, 2013 for PCT/US2012/069442, international filing date Dec. 13, 2012.

* cited by examiner

LED ILLUMINATION DEVICE WITH VENT TO HEAT SINK

RELATED APPLICATIONS AND CLAIM OF PRIORITY

This patent document claims priority to U.S. provisional patent application No. 62/271,471, filed Dec. 28, 2015, the disclosure of which is hereby incorporated by reference in full.

BACKGROUND

The advent of light emitting diode (LED) based luminaires has provided sports arenas, stadiums, other entertainment facilities, and other commercial and industrial facilities the ability to achieve instant on-off capabilities, intelligent controls and adjustability while delivering excellent light quality, consistent light output, and improved energy efficiency. Because of this, users continue to seek improvements in LED lighting devices. For example, new and improved ways to direct light in multiple directions, and at the same time provide luminaires with high light output in a compact package with a low effective projected area (EPA), are desired.

This document describes new illumination devices that are directed to solving the issues described above, and/or other problems.

SUMMARY

In an embodiment, a light fixture includes a housing with a body portion. The body portion may include an opening at a first end and a power supply at an opposing second end. A heat sink including a plurality of fins is disposed between the opening and the power supply, and a mating surface is positioned proximate to the opening. The mating surface may include a plurality of landing pad areas and a plurality of open areas. The light fixture also includes a plurality of light emitting diode (LED) modules, each of which is positioned in the opening and secured to a landing pad area of the mating surface. The LED modules are arranged so that the plurality of open areas remain open to the atmosphere and provide an air path to and from the heat sink.

In an embodiment, the open areas and fins may be arranged so that precipitation can pass through a channel that extends from an open area, between the fins, to the second end of the body portion. Optionally, the open areas and fins may be arranged so that precipitation can pass through a channel that extends from the second end of the body portion, between the fins, to an open area.

In an embodiment, each LED module may include a plurality of LEDs, a plurality of lenses, a circuit board on which the LEDs are mounted, and a frame that holds the LEDs, lenses and circuit board. Each of the plurality of lenses is positioned over a corresponding LED.

In some embodiments, the light fixture may also include a shroud that is positioned to shield an upper portion of the opening. The shroud may include a plurality of fins that are integral with a group of the fins of the body portion so that the shroud is configured to serve as a portion of the heat sink. In an embodiment, a length of the shroud may be configured to reduce an effective projected area (EPA) of the light fixture. For example, when the opening of the body portion has a diameter X, the length of the shroud between a first end attached to the opening of the body portion and a second opposite end may be about 0.25 X to about 0.4 X. The EPA of the light fixture may be about 1.1 ft.$^2$ to about 2.0 ft$^2$. Alternatively and/or additionally, a distance between the first end and the second end of the body portion is about 0.6 X to about 0.75 X. In an embodiment, a lumen output of the light fixture may be about 60,000 lumens/ft$^2$ EPA.

In an embodiment, the open areas may be configured so that when the LED modules operate, the LED modules will generate heat and create a negative pressure that will draw ambient air through the open areas into the housing.

In another aspect of the disclosure, a light fixture may include a housing. The housing may include a body portion having an opening at a first end and a power supply at an opposing second end. The housing may also include a heat sink and a shroud that is positioned to shield an upper portion of the opening. The heat sink includes a plurality of fins between the opening and the power supply. The shroud may include a plurality of fins that are integral with a group of the fins of the body portion so that the shroud is configured to serve as a portion of the heat sink. The light fixture further includes a plurality of light emitting diode (LED) modules, each of which is positioned in the opening.

In an embodiment, a length of the shroud may be configured to reduce an effective projected area (EPA) of the light fixture. For example, when the opening of the body portion has a diameter X, the length of the shroud between a first end attached to the opening of the body portion and a second opposite end may be about 0.25 X to about 0.4 X. The EPA of the light fixture may be about 1.1 ft.$^2$ to about 2.0 ft$^2$. Alternatively and/or additionally, a distance between the first end and the second end of the body portion is about 0.6 X to about 0.75 X. In an embodiment, a lumen output of the light fixture may be about 60,000 lumens/ft$^2$ EPA.

In another embodiment, the housing may also include a mating surface positioned proximate to the opening. The mating surface includes a plurality of landing pad areas and a plurality of open areas. Each of the LED modules is positioned in the opening and secured to a landing pad area of the mating surface such that the plurality of open areas remain open to the atmosphere and provide an air path to and from the heat sink. The open areas and fins may be arranged so that precipitation can pass through a channel that extends from an open area, between the fins, to the second end of the body portion. Optionally, the open areas and fins may be arranged so that precipitation can pass through a channel that extends from the second end of the body portion, between the fins, to an open area. Additionally and/or alternatively, the plurality of open areas may be configured so that when the LED modules operate, the LED modules will generate heat and create a negative pressure that will draw ambient air through the plurality of open areas into the housing.

In another aspect, a shroud for a light fixture may include a plurality of fins that are integral with a group of the fins of a heat sink of a light fixture so that the shroud is configured to serve as a portion of the heat sink. The shroud may also be configured to reduce an effective projected area (EPA) of the light fixture.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a light fixture is oriented in a first direction. The relative orientations of the components may be reversed, or the components may be on the same plane, if the orientation of a light fixture that contains the components is changed. The claims are intended to include all orientations of a device containing such components.

Figure 1:
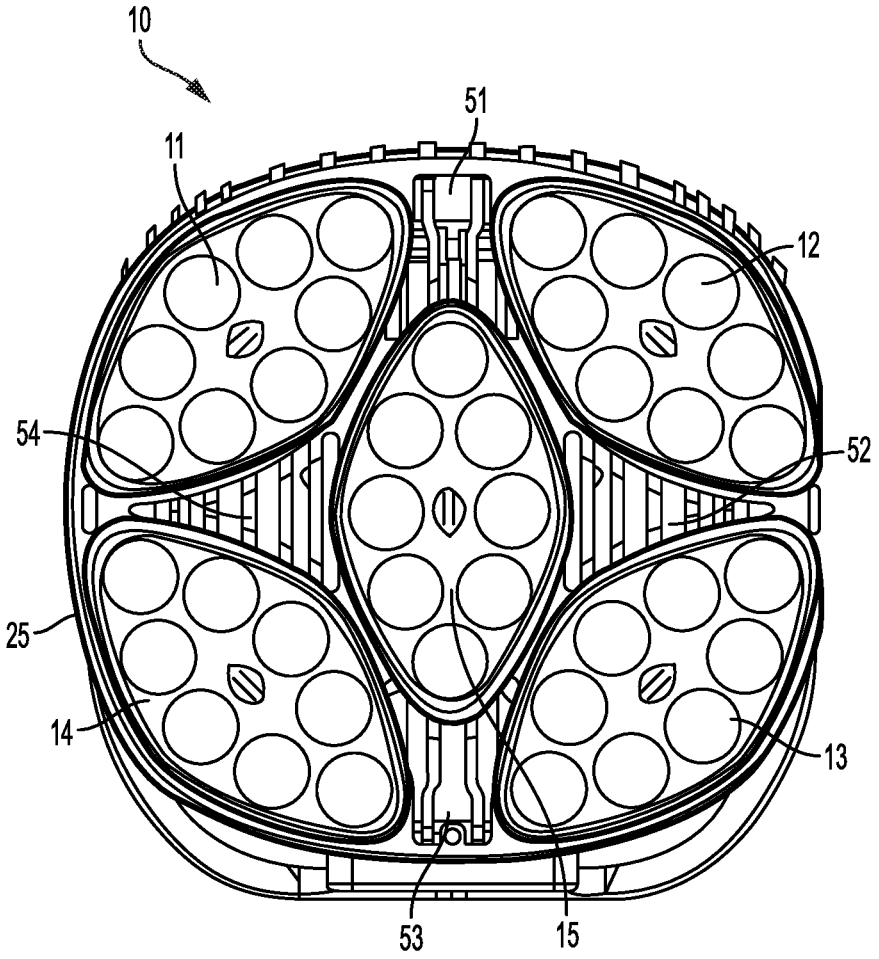
FIG. 1 illustrates a front view of an example of one embodiment of the illumination devices disclosed in this document.
Figure 2:
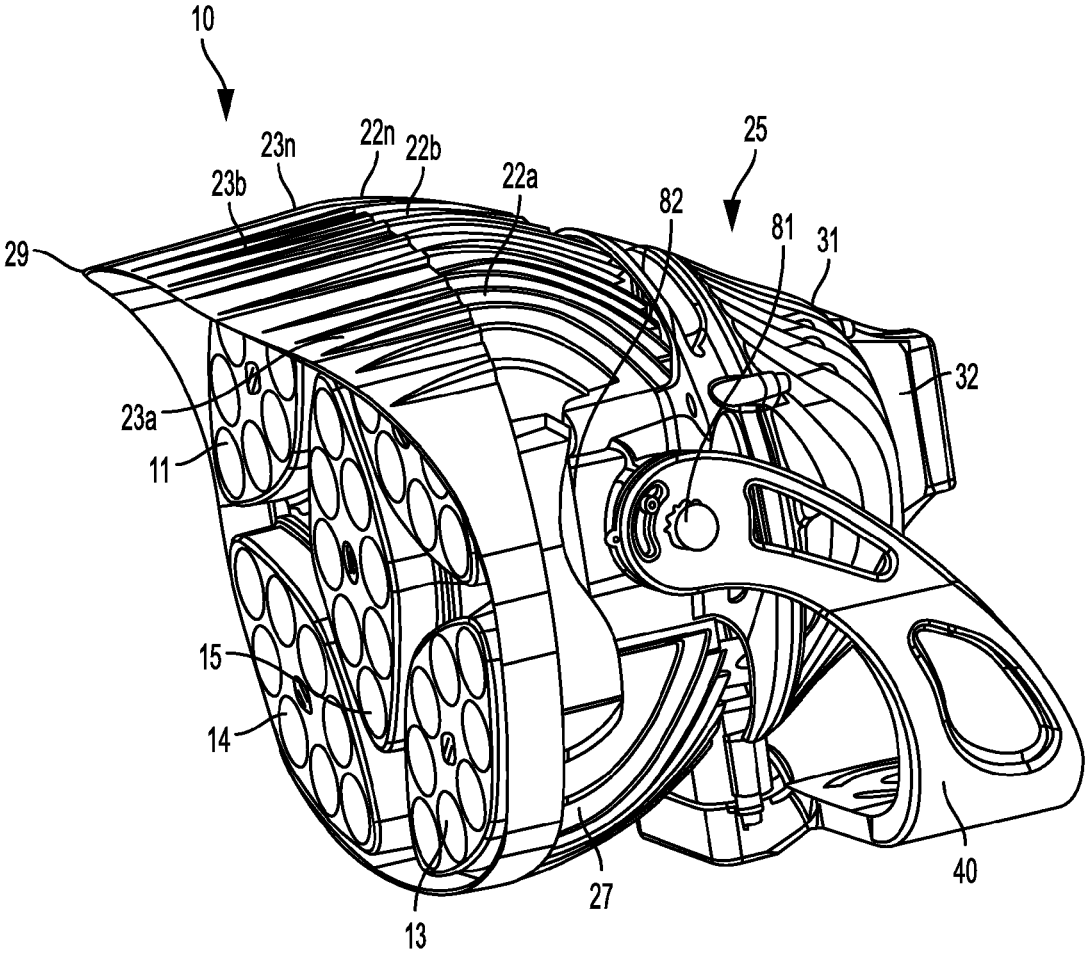
FIG. 2 provides a perspective view of the device of FIG. 1.
Figure 3:
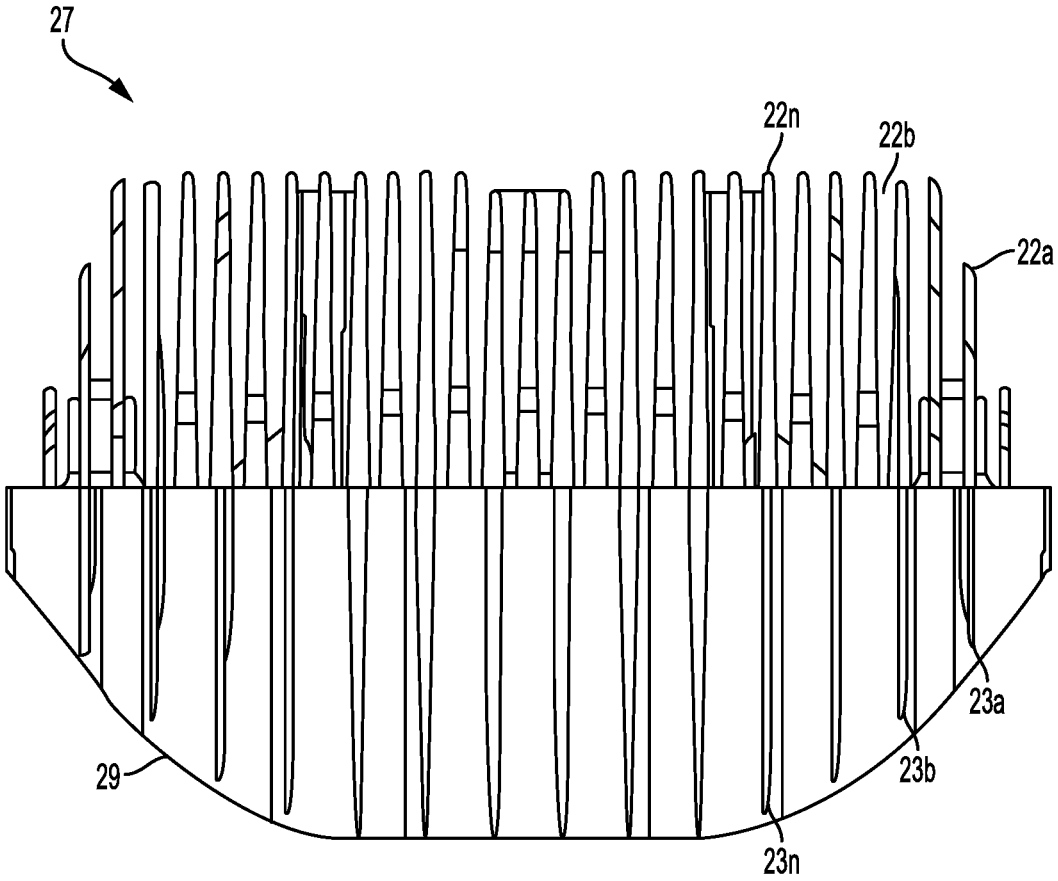
FIG. 3 illustrates a view of a portion of the top of the device of FIG. 1.

FIG. 1 illustrates a front view of an example of one embodiment of the illumination devices disclosed in this document. FIG. 2 illustrates a view from one side of the device of FIG. 1, while FIG. 2 provides a perspective view. FIG. 3 illustrates a view of a portion of the top of the device. The illumination device 10 includes a housing 25 that encases various components of a light fixture. As shown in FIG. 1, the housing 25 includes an opening in which a set of light emitting diode (LED) modules 11-15 are secured to form a multi-module LED structure. The LED modules 11-15 are positioned to emit light away from the fixture. Each LED module includes a frame that holds a set of LEDs arranged in an array or other configuration. In various embodiments the number of LEDs in each module may be any number that is sufficient to provide a high intensity LED device. Each LED module will also include a substrate on which the LEDs, various conductors and/or electronic devices, and lenses for the LEDs are mounted.

The opening of the housing 25 may be circular, square, or a square with round corners as shown in FIG. 1, although other shapes are possible. The LED modules 11-15 may include five modules as shown, with four of the modules 11-14 positioned in a quadrant of the opening and the fifth module 15 positioned in the center as shown. Alternatively, any other number of LED modules, such as one, two, three, four or more LED modules, may be positioned within the opening in any configuration.

The device's housing 25 includes a body portion 27 and an optional shroud portion 29. The body portion 27 serves as a heat sink that dissipates heat that is generated by the LED modules. The body/heat sink 27 may be formed of aluminum and/or other metal, plastic or other material, and it may include any number of fins 22*a* . . . 22*n* on the exterior to increase its surface area that will contact a surrounding cooling medium (typically, air). Thus, the body portion 27 or the entire housing 25 may have a bowl shape as shown, the LED modules 11-15 may fit within the opening of the bowl, and heat from the LED modules 11-15 may be drawn away from the LED modules and dissipated via the fins 22*a* . . . 22*n* on the exterior of the bowl.

While the LED modules are positioned at the front of body portion 27, the opposing side of the body portion may be attached to a power supply unit 31, optionally via a thermal interface plate. The power supply unit 31 may include a battery, solar panel, or circuitry to receive power from an external and/or other internal source. A power supply unit 31 may be positioned at the rear of the body (i.e., at the bottom of the bowl), and the interior of the unit may include wiring or other conductive elements to transfer power and/or control signals from the power supply unit 31 to the LED modules 11-15. The power supply unit 31 may be positioned at or near the rear of the body as shown, or it may be placed into the housing so that it is flush or substantially flush with the rear of the body 27, or it may be configured to extend to some point between being flush with the body portion 27 and an extended position. A control circuitry housing 32 may be attached to the power supply and/or other part of the device as shown, and it may contain control and communications hardware for controlling the device, receiving commands, and transmitting data to remote control devices.

The housing 25 may be formed as a single piece, or it may be formed of two pieces that fit together as in a clamshell-type structure. In a clamshell design, a portion of the interior wall of the clamshell near its opening may include a groove, ridge, or other supporting structure that is configured to receive and secure the LED structure in the opening when the clamshell is closed. In addition, the fins 22*a* . . . 22*n* may be curved or arced as shown, with the base of each fin's curve/arc positioned proximate the opening/LED modules, and the apex of each fin's curve/arc positioned distal from the opening/LED modules to further help draw heat away from the LED modules. The housing may be attached to a support structure 40, such as a base or mounting yoke, optionally by one or more connectors 81. As shown, the connectors 81 may include axles about which the housing and/or support structure may be rotated to enable the light assembly to be positioned to direct light at a desired angle. The light fixture may include or be connected to a motor 82 that, when actuated, causes the housing to rotate about the connectors and adjust an orientation of the lighting device. Other motors may be used in different locations (such as attached to the mounting yoke) to adjust pitch, yaw, or other positional aspects of the lighting device.

The power supply unit 31 may be detachable from remainder of the lighting device's housing 25 so that it can be replaced and/or removed for maintenance without the need to remove the entire device from an installed location, or so that it can be remotely mounted to reduce weight. The power supply unit 31 and/or a portion of the lighting unit housing 25 may include one or more antennae, transceivers or other communication devices that can receive control signals from an external source. For example, the illumination device may include a wireless receiver and an antenna that is configured to receive control signals via a wireless communication protocol. Optionally, a portion of the lighting unit housing 25 or shroud 29 (described below) may be equipped with an attached laser pointer that can be used to identify a distal point in an environment to which the lighting device directs its light. The laser pointer can thus help with installation and alignment of the device to a desired focal point.

FIGS. 1-3 show that the device may include a shroud 29 that protects and shields the LED modules 11-15 from falling rain and debris, and that may help direct light toward an intended illumination surface. The shroud 29 may have any suitable width so that an upper portion positioned at the top of the housing is wider than a lower portion positioned at the bottom and/or along the sides of the opening of the housing. This may help to reduce the amount of light wasted to the atmosphere by reflecting and redirecting stray light downward to the intended illumination surface. FIGS. 2 and 3 illustrate that in an embodiment, some or all of the fins 22*a*-22*n* of the housing may be contiguous with fin portions 23*a*-23*n* that extend across the shroud 29. With this option, the shroud 29 can also serve as part of the heat sink.

The integration of the shroud with the heat sink of the body can help reduce the effective projected area (EPA) of the device. Objects elevated to substantial heights are subject to wind loading. A number of factors determine the load placed on an object exposed to wind. Wind speed and the presence of surrounding objects which may disturb air flow are two such factors. Also of relevance to wind loading is the shape of the object itself. The portion of the object directly abutting the air flow path is often referred to as the projected area. For lighting fixtures, the projected area will often change as the aiming angle of the fixture changes.

EPA is a value used to determine how much force a lighting device will apply to the mounting bracket, pole, or other mounting apparatus at a given wind velocity, and is calculated based on a projected area and a drag coefficient of the light fixture. Specifically, EPA is the exposed surface area of a fixture multiplied by a shape factor that can vary depending on the shape of the fixture or bracket. EPA may be used in combination with the light fixture's weight to determine the mounting requirements for a particular application. Hence, keeping the EPA and the weight of a lighting fixture low may help reduce the cost of a mounting apparatus. However, lowering the EPA must be balanced against other light fixture requirements such as light fixture aiming and efficient heat dissipation.

The above factors may be balanced using the shroud as a portion of the heat sink in order to reduce the size of the heat sink and hence the body portion, which can help reduce EPA. However, while increasing the shroud length may help increase the efficiency of the heat sink, it will also increase the EPA of the fixture. Hence, in an embodiment, the ratio of the shroud length to the light fixture dimensions is carefully calibrated in order to get a desired heat dissipation while keeping the EPA low. For example in an embodiment, where a diameter of a circular opening of the housing 25 (and/or the distance between opposite corners of a square opening/square opening with round corners) is X, the distance between the opening and a second end of the housing 25, may be about 0.6 X to about 0.75 X. A length of the shroud 29 between a first end attached to the opening and a second opposite end may be about 0.25 X to about 0.4 X. In an embodiment, the distance between the opening and a second end of the housing 25, may be about 0.6 X, 0.65 X, 0.67 X, 0.7 X, or 0.75 X, and the length of the shroud 29 may be about 0.25 X, 0.3 X, 0.33 X, 0.35 X, or 0.4 X. These dimensional relationships are provided by way of example only and other values such as +/−5% of the above values are within the scope of this disclosure.

For example, in various embodiments the devices with an integral shroud/heat sink, according to the above configuration, can help to provide a device with an EPA of less than 2.0 $ft^2$, about 1.8 $ft^2$, about 1.6 $ft^2$, about 1.4 $ft^2$, about 1.1 $ft^2$, or any range in between any combination of these numbers. In various embodiments, the lumen output of the device may be in the range of about 60,000-75,000 lumens per $ft^2$ EPA. For example, the lumen output may be about 85,000 lumens at 1.4 $ft^2$ EPA (i.e., about 60,000 lumens/$ft^2$ EPA. Other lumen output values are possible. The above values are provided by way of example only and other values such as +/−10% of the above values are within the scope of this disclosure.

The top view of FIG. 3 also helps to illustrate how the heat sink may help to keep the lighting device cool. In the embodiment shown in FIG. 3, the body portion 27 of the housing may be open so that the fins 22*a* . . . 22*n* are positioned to extend away from the shroud 29 at an angle that is substantially perpendicular to the plane on which the LED modules sit (i.e., the plane of the housing's opening.

The fins 22*a* . . . 22*n* may be positioned substantially vertically (i.e., lengthwise from a top portion of the LED array structure and shroud 29 to a bottom portion of the same). Optionally, one or more lateral supports may be interconnected with the fins to provide support to the housing. The lateral supports may be positioned substantially parallel to the axis of the fins, or they may be curved to extend away from the LED structure, or they may be formed of any suitable shape and placed in any position. Each support may connect two or more of the fins. The fins and optional supports form the body portion 27 as a grate, and hot air may rise through the spaces that exist between the fins and supports of the grate. In addition, precipitation may freely fall through the openings of the grate. In addition, any small debris (such dust or bird droppings) that is caught in the grate may be washed away when precipitation next occurs.

Figure 4:
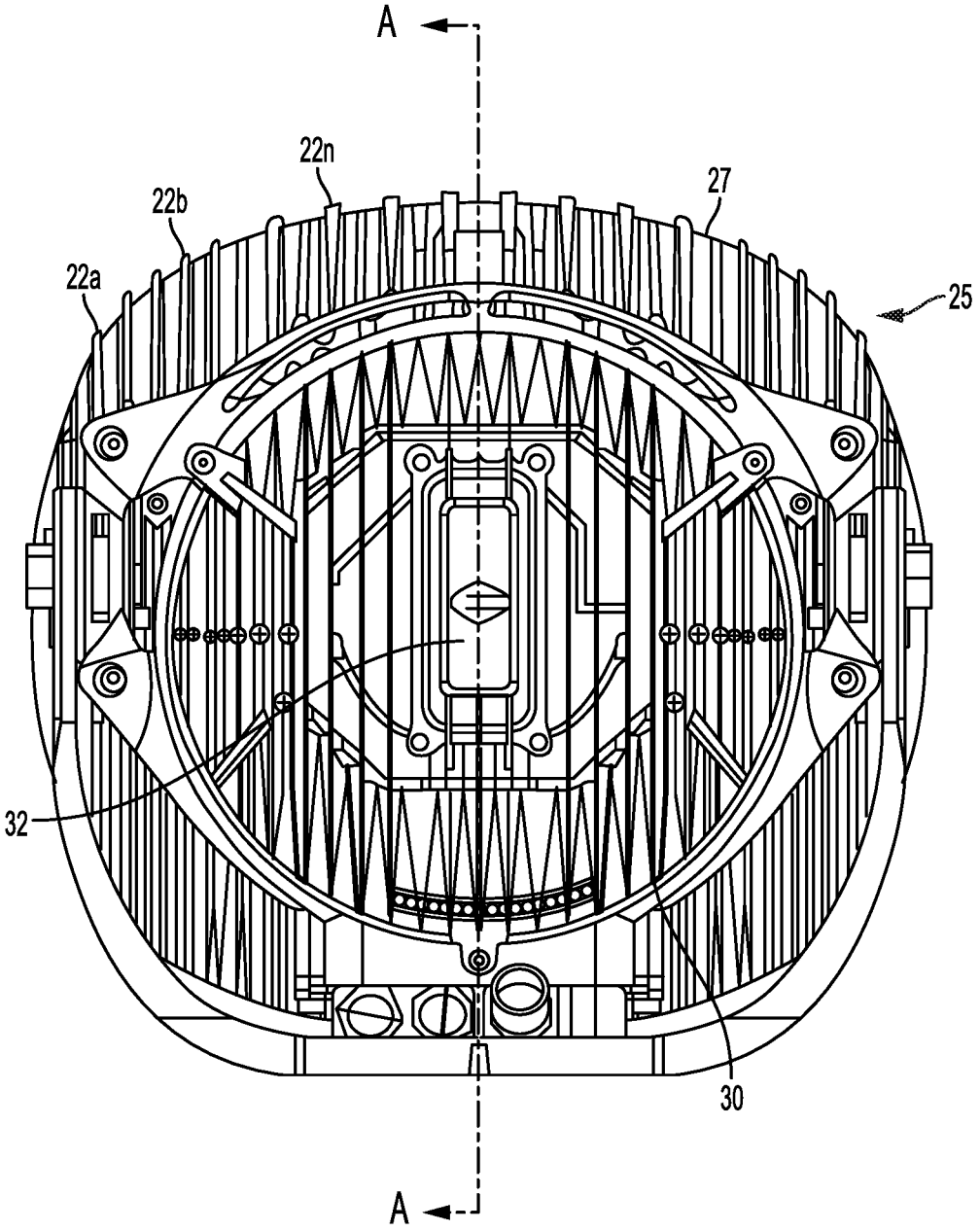
FIG. 4 illustrates an embodiment of the lighting device, viewed from the rear.

FIG. 4 illustrates an embodiment of the lighting device as viewed from the rear. As with the other views, the fins 22*a* . . . 22*n* may be positioned substantially vertically to form a heat sink. The power supply 30 and control circuitry housing 32 may be connected at the rear of the device as shown.

FIG. 1 also helps to illustrate components of the lighting device that can, in some embodiments, have self-cooling effects through its use of openings 51-54 that include open areas in the front of the housing and between the LED modules. When the LED modules operate, heat generated by the LEDs will rise and dissipate through the heat sink, creating a negative pressure that may draw cool ambient air into the housing via the openings 51-54 that are positioned proximate to (i.e., at, near or around) the LED modules 11-15. This chimney effect helps keep the LED modules and other components cool during operation. The openings 51-54 may each be contiguous components of a single opening, so that the central LED module 15 is surrounded by an open space, while the LED modules 11-14 positioned in each quadrant have a portion of the opening positioned along approximately half of their perimeters.

Figure 5:
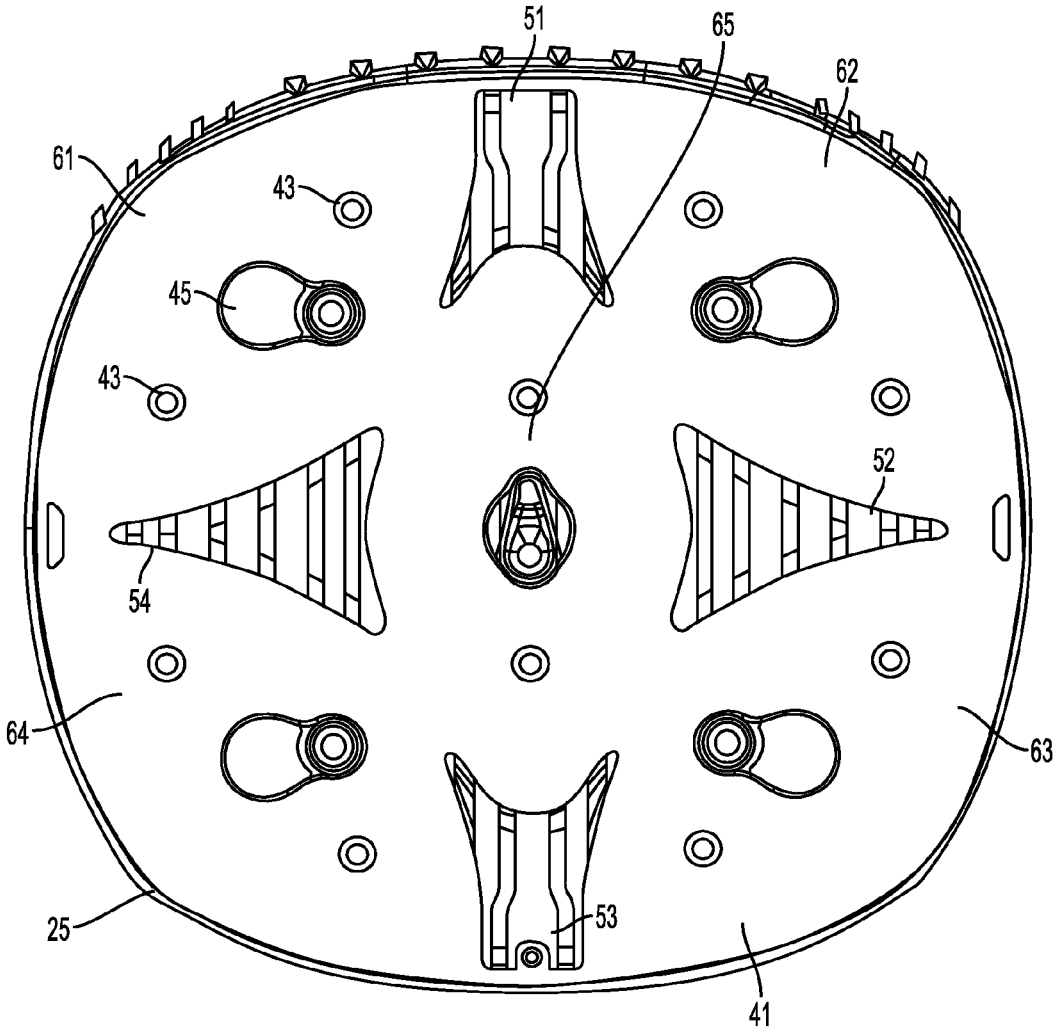
FIG. 5 illustrates a view of the heatsink, as viewed from the opening (front) of the device with the LED modules removed.

FIG. 5 shows the front of the device with the LED modules removed, to expose a mating surface 41 to which the LED modules are mounted. The mating surface 41 is connected to the fins and has a front surface with a lateral dimension that is parallel to the fins, so that the mating surface substantially fills the opening in front of the lighting device, and the fins extend away from the mating surface toward the rear of the device. In an embodiment, the mating surface and fins may be formed by being cast or molded from a common material, such aluminum, an alloy, or a ceramic material. The mating surface 41 includes a number of landing pads 61-65 that corresponds to the number of LED modules. Each landing pad comprises an area of the surface with one or more connectors 43 (such as openings to receive a bolt) that are configured to secure an LED module to the mating surface 41. Each landing pad also may include one or more openings 51-54 that serve as open areas to conduits that provide a sealed path between the LED modules and other components of the lighting device.

Figure 6:
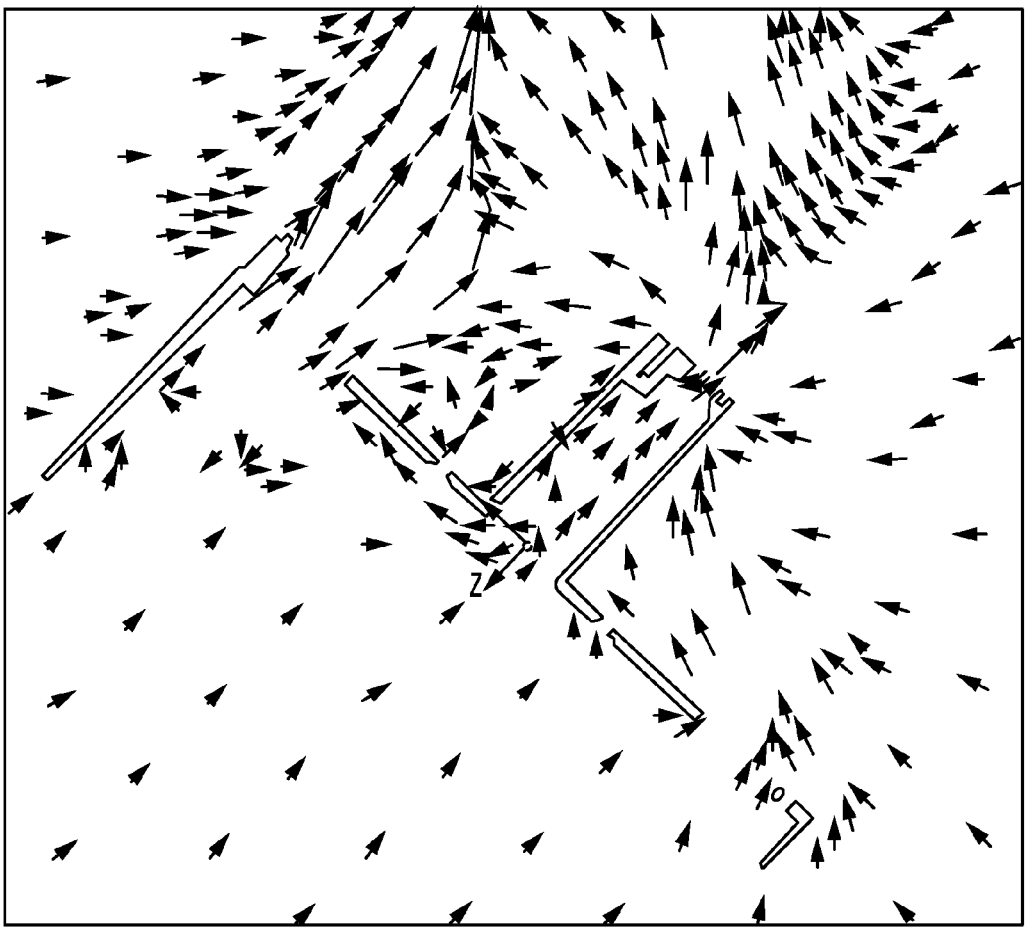
FIG. 6 illustrates an air flow path through and around an embodiment of the lighting device.
Figure 7A:
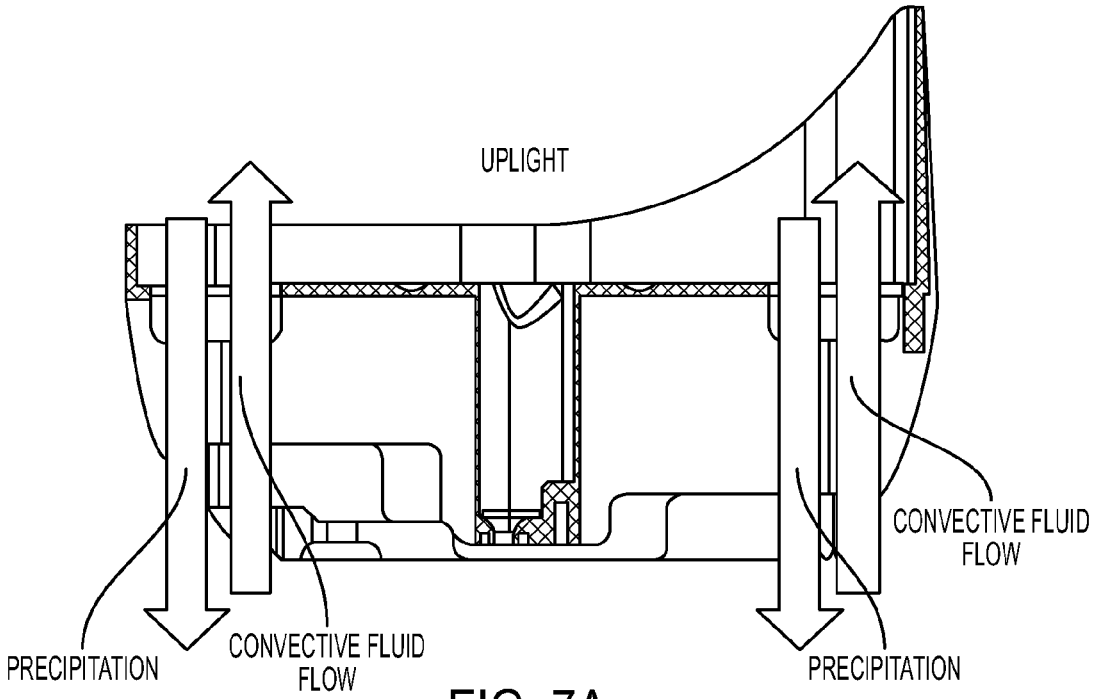
FIGS. 7A and 7B illustrate how air and precipitation may flow through the body of the lighting device depending on the device's orientation.
Figure 7B:
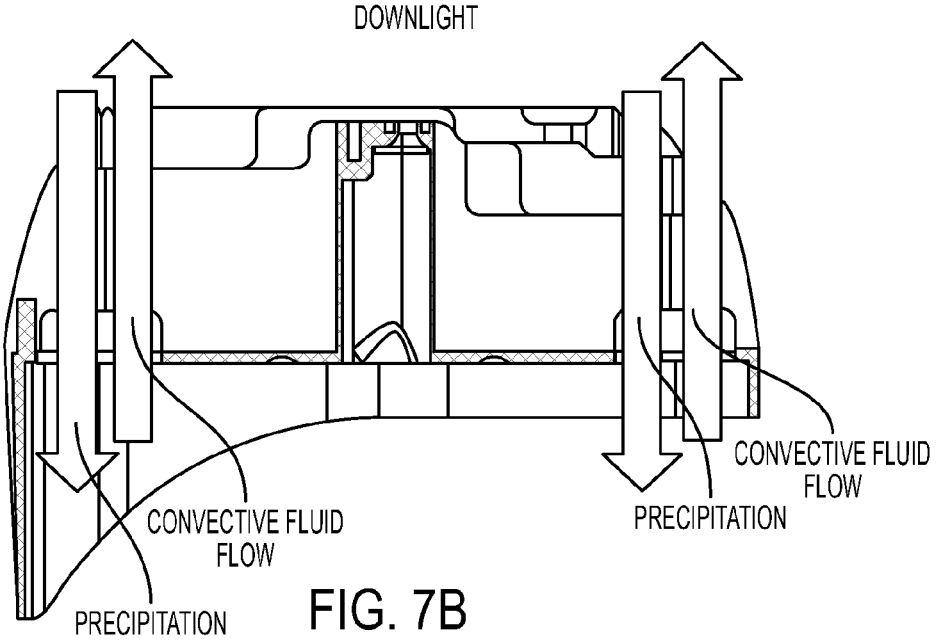

When the LED modules are arranged over the landing pads, the open areas remain open to the atmosphere and provide an air path to and from the heat sink (see FIG. 1). FIG. 6 illustrates an example of a path of air flow in which air moves into the device's front opening and passes through the heat sink body portion 27 toward the rear of the device. The open structure of the fins also allows precipitation to fall through the device, entering from the front (LED module area) and exiting through the rear, or vice versa. FIGS. 7A and 7B illustrate how air and precipitation may flow through the front opening of the device and the device's body, depending on whether the LED modules are oriented more upward FIG. 7A) or more downward (FIG. 7B).

Figure 8:
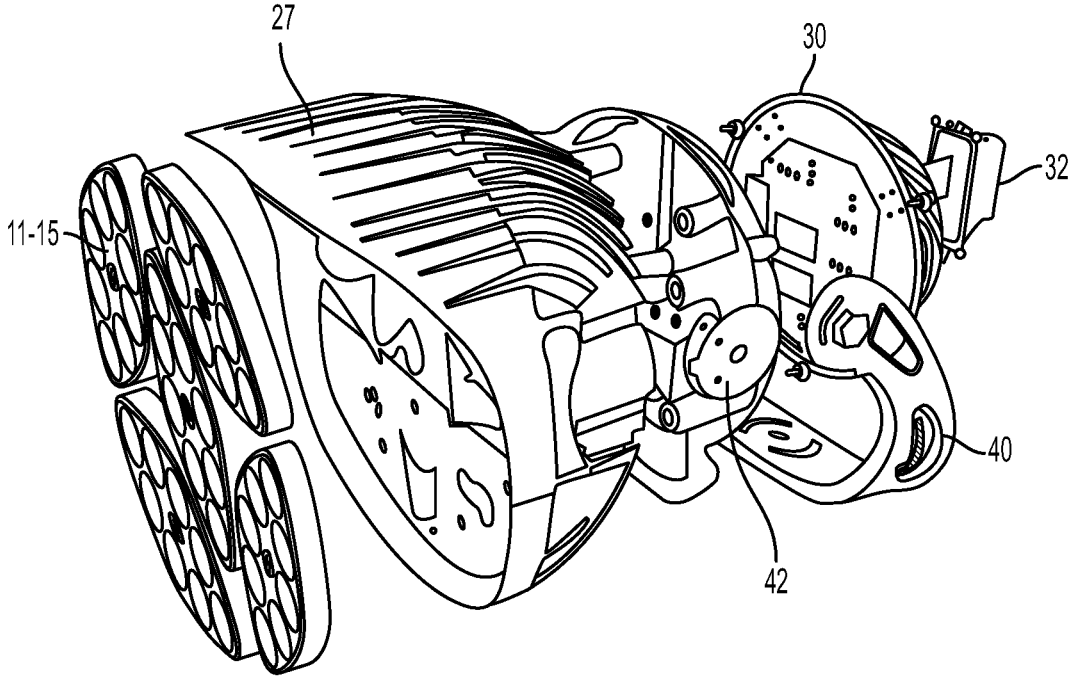
FIG. 8 is an expanded view of various components of the device of FIG. 1.

FIG. 8 is an expanded view of an embodiment of the lighting device, showing components including the body portion 27 (which includes a heat sink and is integral with a shroud), the LED modules 11-15, the mounting bracket/support structure 40, power supply 30 and control circuitry housing 32. A thermal separation interface 42 separates the power supply from the heat sink. The power supply may be connected to one side of the interface 42, and the other side of the interface 42 may connect to the fins of the heat sink. The thermal separation interface 42 may be made of materials that help shield the LED modules from heat generated by the power supply. Such materials may include, for example, aluminum, plastic, ceramic, carbon fiber, composite materials or other materials.

It is intended that the portions of this disclosure describing LED modules, control systems and methods are not limited to the embodiment of the illumination devices disclosed in this document. The LED modules, control systems and control methods may be applied to other LED illumination structures, such as those disclosed in U.S. Patent Application Pub. No. 2014/0334149 (filed by Nolan et al. and published Nov. 13, 2014), and in U.S. Patent Application Pub. No. 2015/0167937 (filed by Casper et al. and published Jun. 18, 2015), the disclosures of which are fully incorporated herein by reference.

The features and functions described above, as well as alternatives, may be combined into many other systems or applications. Various presently unforeseen or unanticipated alternatives, modifications, variations or improvements may be made by those skilled in the art, each of which is also intended to be encompassed by the disclosed embodiments.

The invention claimed is:

1. A light fixture comprising:

a housing comprising:

a body portion comprising an opening at a first end, a power supply at an opposing second end, a heat sink comprising a plurality of fins between the opening and the power supply, and a mating surface positioned proximate to the opening, the mating surface comprising a plurality of landing pad areas and a plurality of open areas;

a plurality of light emitting diode (LED) modules, each of which is positioned in the opening and secured to a landing pad area of the mating surface, wherein the LED modules are arranged so that the plurality of open areas remain open to the atmosphere and provide an air path to and from the heat sink; a shroud attached to an upper portion of the opening such that the shroud is not parallel to the opening, the opening of the body portion has a diameter X; and a length of the shroud between a first end attached to the opening of the body portion and a second opposite end is about 0.25 X to about 0.4 X, such that the shroud is configured to reduce an effective projected area (EPA) of the light fixture.

2. The light fixture of claim 1, wherein the open areas and fins are arranged so that precipitation can pass through a channel that extends from an open area, between the fins, to the second end of the body portion.

3. The light fixture of claim 1, wherein the open areas and fins are arranged so that precipitation can pass through a channel that extends from the second end of the body portion, between the fins, to an open area.

4. The light fixture of claim 1, wherein each LED module comprises:

a plurality of LEDs;

a plurality of lenses, each of which is positioned over a corresponding LED;

a circuit board on which the LEDs are mounted; and a frame that holds the LEDs, the lenses and the circuit board.

5. The light fixture of claim 1, wherein the shroud is positioned to perform one or more of the following: shield the plurality of LED modules from rain and debris, or direct light from one or more of the plurality of LED modules towards an intended illumination surface.

6. The light fixture of claim 5, wherein the shroud comprises a plurality of fins that are integral with a group of the fins of the body portion so that the shroud is configured to serve as a portion of the heat sink.

7. The light fixture of claim 1, wherein a distance between the first end and the second end of the body portion is about 0.6 X to about 0.75 X.

8. The light fixture of claim 1, wherein the EPA of the light fixture is about 1.1 $ft^2$ to about 2.0 $ft^2$ .

9. The light fixture of claim 1, wherein a lumen output of the light fixture is about 60,000 lumens/$ft^2$ EPA.

10. The light fixture of claim 1, wherein the open areas are configured so that when the LED modules operate, the LED modules will generate heat and create a negative pressure that will draw ambient air through the open areas into the housing.

11. A light fixture comprising:

a housing comprising:

a body portion comprising an opening at a first end, a power supply at an opposing second end, a heat sink comprising a plurality of fins between the opening and the power supply, and a shroud attached to an upper portion of the opening such that the shroud is not parallel to the opening and that is positioned to shield the upper portion of the opening, wherein the shroud comprises a plurality of fins that are integral with a group of the fins of the body portion so that the shroud is configured to serve as a portion of the heat sink; a plurality of light emitting diode (LED) modules, each of which is positioned in the opening, the opening of the body portion has a diameter X; and a length of the shroud between a first end attached to the opening of the body portion and a second opposite end is about 0.25 X to about 0.4 X, such that the shroud is configured to reduce an effective projected area (EPA) of the light fixture.

12. The light fixture of claim 11, wherein a distance between the first end and the second end of the body portion is about 0.6 X to about 0.75 X.

13. The light fixture of claim 11, wherein the EPA of the light fixture is about 1.1 $ft^2$ to about 2.0 $ft^2$.

14. The light fixture of claim 11, wherein a lumen output of the light fixture is about 60,000 lumens/$ft^2$ EPA.

15. The light fixture of claim 11, wherein the housing further comprises a mating surface positioned proximate to the opening, the mating surface comprising a plurality of landing pad areas and a plurality of open areas, wherein each of the LED modules is positioned in the opening and secured to a landing pad area of the mating surface such that the plurality of open areas remain open to the atmosphere and provide an air path to and from the heat sink.

16. The light fixture of claim 15, wherein the open areas and fins are arranged so that precipitation can pass through a channel that extends from an open area, between the fins, to the second end of the body portion.

17. The light fixture of claim 15, wherein the open areas and fins are arranged so that precipitation can pass through a channel that extends from the second end of the body portion, between the fins, to an open area.

18. The light fixture of claim 15, wherein the plurality of open areas are configured so that when the LED modules operate, the LED modules will generate heat and create a negative pressure that will draw ambient air through the plurality of open areas into the housing.

19. A shroud for a light fixture comprising:

a plurality of fins that are integral with a group of the fins of a heat sink of a light fixture so that the shroud is configured to serve as a portion of the heat sink, the shroud is attached to an opening of diameter X of the light fixture; and a length of the shroud between a first end attached to the opening of the body portion and a second opposite end is about 0.25 X to about 0.4 X, such that the shroud is configured to reduce an effective projected area (EPA) of the light fixture.

20. The shroud of claim 19, wherein:

the EPA of the light fixture is about 1.1 $ft^2$ to about 2.0 $ft^2$.

* * * * *